US005372611A

United States Patent [19]

Christie et al.

[11] Patent Number: 5,372,611

[45] Date of Patent: Dec. 13, 1994

[54] LIQUID ALKALI FOR REACTIVE DYEING OF TEXTILES

[75] Inventors: Nick J. Christie, Burlington, N.C.; Samuel G. Jones, Blairs, Va.

[73] Assignee: Apollo Chemical Corporation, Graham, N.C.

[21] Appl. No.: 954,589

[22] Filed: Sep. 30, 1992

[51] Int. Cl.[5] ..... D06M 11/82; D06P 1/38

[52] U.S. Cl. ..... 8/543; 8/125; 8/630; 8/632; 252/156; 252/157

[58] Field of Search ..... 8/543, 125, 630, 632; 252/156, 157

[56] References Cited

U.S. PATENT DOCUMENTS

| | | | |
|---|---|---|---|
| 4,494,956 | 1/1985 | Schäfer et al. | 8/543 |
| 4,555,348 | 11/1985 | Moran | 252/1 |
| 4,731,092 | 3/1988 | Berendt | 8/543 X |
| 4,902,439 | 2/1990 | Abei et al. | 252/174.25 |
| 4,915,865 | 4/1990 | Westermann et al. | 252/156 X |
| 5,047,064 | 9/1991 | Rizzardi | 8/125 |
| 5,242,466 | 9/1993 | Aseervatham et al. | 8/543 |

OTHER PUBLICATIONS

Brochure entitled "REMOL FB", dated Jan. 1988, HCF 2710, Hoechst Celanese Corp., Charlotte, N.C.

*Primary Examiner*—Johann Richter
*Assistant Examiner*—Michael B. Hydorn
*Attorney, Agent, or Firm*—Rhodes Coats & Bennett

[57] ABSTRACT

A liquid alkali composition for use in fiber reactive dyeing of cotton and cotton blended fabrics or the like. The liquid alkali is a water-based solution of an alkali metal hydroxide and an alkali metal silicate. Preferably the composition is an aqueous mixture of potassium hydroxide and sodium silicate. In the most preferred embodiment the composition includes 35 wt % potassium hydroxide at a 45 wt % concentration, 25 wt % sodium silicate at 50° Baumé, 5 wt % of a borate, and the balance water. The resulting solution has a high enough pH to achieve reaction between the dye and fiber but is sufficiently buffered to achieve this reaction slowly so that the fiber reactive dyes fix in a level, uniform fashion.

4 Claims, 1 Drawing Sheet

LIQUID ALKALI FOR REACTIVE DYEING OF TEXTILES

BACKGROUND OF THE INVENTION (1) Field of the Invention

The present invention relates generally to the dyeing of textiles and, more particularly, to a liquid alkali for use in fiber reactive dyeing of cotton and cotton blended fabrics.

(2) Description of the Prior Art

Fiber reactive dyes were first introduced in the mid 1950's. Since that time they have become a dominant factor in dyeing cotton, regenerated cellulose and blends. These dyes can also be used to dye acrylics, nylon, silk, wool and blends of these fibers. Fiber reactive dyes are easy to apply and produce brilliant shades, fastness, penetration and leveling.

Fiber reactive dyes are anionic in nature and react chemically with the fiber. The dyes include a chromophore to give color to the dye and a reactive group to form a chemical bond with the fiber. There may also be a substitutent or solubilizing group which provides additional dyeing characteristics such as solubility, substantivity, migration, washing off, etc. Fiber reactive dyes react in the presence of alkali to form a strong covalent chemical bond between a carbon atom of the dye molecule and an oxygen atom of the hydroxyl group in the cellulose. This step is called "fixing".

No single alkali system has worked on all classes of reactive dyes due to the differences in the rate of hydrolysis of each dye. Of all the alkali systems, the liquid phosphate system described in U.S. Pat. No. 4,555,348, issued to Moran, and sold under the tradename "Alkaflo" by Sybron Chemicals of Birmingham, N.J., works almost universally. But Alkaflo is high in phosphorus which can contribute to environmental problems.

Also, if the reaction mixture is too "hot" or alkaline, such as is seen with pure sodium hydroxide, the sensitive-type reactive dyes will hydrolyze with the water in the dyebath and form a nonreactive pigment that has no effect on the fabric color. Furthermore, as fashions have changed, the need to mix reactive dyes of different chemistries in the same shade and the necessity of developing a universal alkali system for cold pad batch dyeing that does not contain phosphorus has become more important.

One attempt at producing a phosphorus-free liquid alkali was recently introduced and is being sold under the tradename "REMOL FB". REMOL FB is available from Hoechst Celanese of Somerville, N.J. According to its Material Safety Data Sheet, REMOL FB contains a mixture including potassium hydroxide and sodium silicate. However, test dyeings indicated that, like pure sodium hydroxide, REMOL FB is too "hot" for many classes of dyestuffs.

Thus, there remains a need for a liquid, phosphorus-free, alkali for use in fiber reactive dyeing of cotton and cotton blended fabrics which has the clean dyeing properties of a phosphorus-based system such as Alkaflo but is not as "hot" as earlier alkali hydroxide/silicate mixtures.

SUMMARY OF THE INVENTION

The present invention is directed to a liquid alkali for use in dyeing of cotton and cotton blended fabrics. The liquid alkali is a water-based solution of an alkali metal hydroxide and an alkali metal silicate. Preferably the composition is an aqueous mixture of potassium hydroxide and sodium silicate. In the most preferred embodiment the composition includes 35 wt % potassium hydroxide at a 45 wt % concentration, 25 wt % sodium silicate at 50° Baumé, 5 wt % of a borate, and the balance water. The resulting solution has a high enough pH to achieve reaction between the dye and fiber but is sufficiently buffered to achieve this reaction slowly so that the fiber reactive dyes fix in a level, uniform fashion.

Accordingly, one aspect of the present invention is to provide a liquid composition for use in reactive dyeing of cotton and cotton blended fabrics or the like. The composition includes: (a) an alkali metal hydroxide; (b) an alkali metal silicate; (c) sodium metaborate or sodium perborate; and (d) the balance water.

Another aspect of the present invention is to provide a liquid composition for use in reactive dyeing of cotton and cotton blended fabrics or the like. The composition including: (a) about 30 to 40 wt % of an alkali metal hydroxide; (b) about 10 to 40 wt % of an alkali metal silicate; and (c) the balance water.

Another aspect of the present invention is to provide a liquid composition for use in reactive dyeing of cotton and cotton blended fabrics or the like. The composition includes: (a) about 30 to 40 wt % of an alkali metal hydroxide; (b) about 10 to 40 wt % of an alkali metal silicate; (c) up to about 5 wt % of sodium metaborate or sodium perborate borax and (d) the balance water.

These and other aspects of the present invention will become apparent to those skilled in the art after a reading of the following description of the preferred embodiment when considered with the drawings.

DESCRIPTION OF THE PREFERRED EMBODIMENTS

Figure 1:
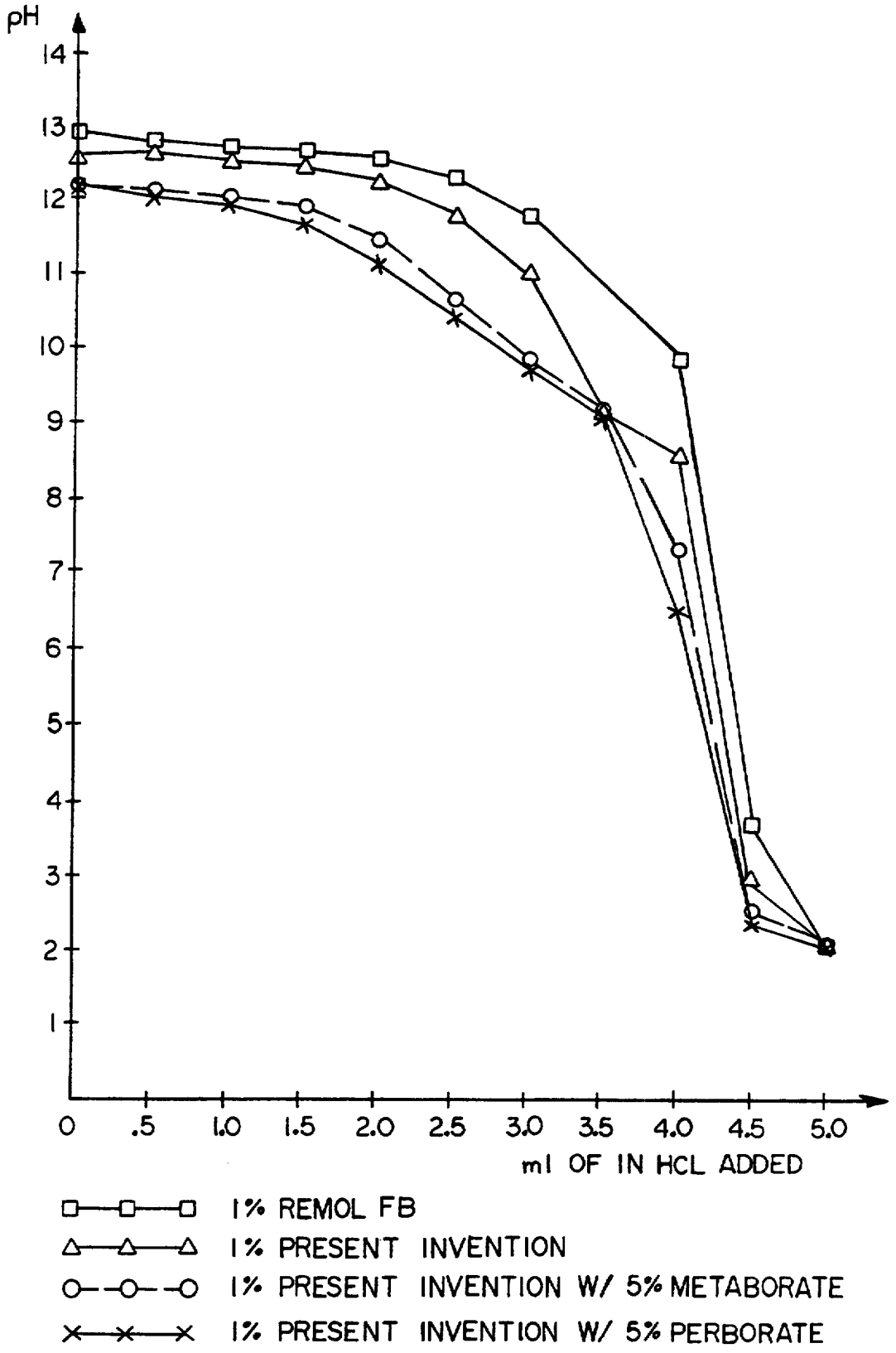
FIG. 1 is a graphical representation of the titration curves for a 1% solution of a liquid alkali prepared according to the present invention.

In the preferred embodiment, the process for preparing the liquid alkali composition of the present invention includes the following steps: Into a mixer containing 40 parts by weight water add 35 parts by weight potassium hydroxide at a 45 wt % concentration and stir. Then add 25 parts by weight sodium silicate at 50° Baumé and stir. Stir until uniform and transfer the mixture into a suitable container.

The liquid alkali of the present invention is added to the dyebath in a range of from 2 to 10 gms/l . The concentration of dyes in the dyebath range up to 5 wt %. Sodium sulfate or other salt ranges between about 80 to 100 gms/l.

The resulting solution has a high enough pH to achieve reaction between the dye and fiber but is sufficiently buffered to achieve this reaction slowly so that the fiber reactive dyes fix in a level, uniform fashion.

Dyeings were made using various ratios of 45 wt % potassium hydroxide and 50° Baumé sodium silicate and compared to conventional dyeing procedures and additives. Color yield was measured relative to a control having a value of 100%. The criteria for suitability was about ±10% of the control. The results are shown below in Examples 1–49.

EXAMPLES 1-7

Conventional reaction dyeings of cotton fabrics were made to determine the red dye yield of the candidate materials. The dye selected was a mixture of 3.50% Cibacron TM Scarlet F-3G and 1.50% Cibacron TM Red F-B. These dyes are available from Ciba-Geigy Corporation of Ardsley, N.Y. These dyes were chosen because they are sensitive to high alkalinity, i.e., they dye weak when too much alkalinity is used because of hydrolysis. The dyebath included 80 gms/l of sodium sulfate. Dyeing took place at 140° F. for 40 minutes. The liquid alkali was added at 3 gms/l. The liquor ratio was 20 to 1. All color yield measurements are in comparison to a conventional dyebath containing 10 gms/l soda ash.

TABLE 1

| Red Dye Trial Results | | | | |
|---|---|---|---|---|
| Example | Composition | | Suitable | Yield |
| 1 | potassium hydroxide | 35% | Y | +1.36% |
| | sodium silicate | 10% | | |
| | balance water | | | |
| 2 | potassium hydroxide | 35% | Y | +0.75% |
| | sodium silicate | 25% | | |
| | balance water | | | |
| 3 | potassium hydroxide | 35% | Y | +4.31% |
| | sodium silicate | 40% | | |
| | balance water | | | |
| 4 | potassium hydroxide | 35% | Y | +3.94% |
| | sodium silicate | 60% | | |
| | balance water | | | |
| 5 | potassium hydroxide | 10% | Y | −3.46% |
| | sodium silicate | 25% | | |
| | balance water | | | |
| 6 | potassium hydroxide | 50% | N | −13.76% |
| | sodium silicate | 25% | | |
| | balance water | | | |
| 7 | potassium hydroxide | 75% | N | −12.11% |
| | sodium silicate | 25% | | |
| | balance water | | | |

EXAMPLES 8-14

Conventional reaction dyeings of cotton fabrics were made to determine the green dye yield of the candidate materials. The dye selected was a mixture of 4.00% Procion TM Turquoise HA, 0.10% Procion TM Blue HERD and 0.80% Procion TM Yellow HE-6G. These dyes are available from ICI America of Wilmington, DE. The dyebath included 100 gms/l of sodium sulfate. Dyeing took place at 175° F. for 40 minutes. The liquid alkali was added at 2 gms/l. The liquor ratio was 20 to 1. All color yield measurements are in comparison to a conventional dyebath containing 20 gms/l soda ash.

TABLE 2

| Green Dye Trial Results | | | | |
|---|---|---|---|---|
| Example | Composition | | Suitable | Yield |
| 8 | potassium hydroxide | 35% | N | +15% |
| | sodium silicate | 10% | | |
| | balance water | | | |
| 9 | potassium hydroxide | 35% | N | +20% |
| | sodium silicate | 25% | | |
| | balance water | | | |
| 10 | potassium hydroxide | 35% | Y | +6% |
| | sodium silicate | 40% | | |
| | balance water | | | |
| 11 | potassium hydroxide | 35% | Y | +9% |
| | sodium silicate | 60% | | |
| | balance water | | | |
| 12 | potassium hydroxide | 10% | N | −22% |
| | sodium silicate | 25% | | |
| | balance water | | | |

TABLE 2-continued

| Green Dye Trial Results | | | | |
|---|---|---|---|---|
| Example | Composition | | Suitable | Yield |
| 13 | potassium hydroxide | 50% | N | +20% |
| | sodium silicate | 25% | | |
| | balance water | | | |
| 14 | potassium hydroxide | 75% | N | +10% |
| | sodium silicate | 25% | | |
| | balance water | | | |

EXAMPLES 15-21

A second group of reaction dyeings of cotton fabrics identical to Examples 8-14 were made to determine the green dye yield of the candidate materials for liquid alkali added at 5 gms/l. The liquor ratio was 20 to 1. All color yield measurements are in comparison to a conventional dyebath containing 20 gms/l soda ash.

TABLE 3

| Green Dye Trial Results (con't) | | | | |
|---|---|---|---|---|
| Example | Composition | | Suitable | Yield |
| 15 | potassium hydroxide | 35% | N | +17% |
| | sodium silicate | 10% | | |
| | balance water | | | |
| 16 | potassium hydroxide | 35% | N | +18% |
| | sodium silicate | 25% | | |
| | balance water | | | |
| 17 | potassium hydroxide | 35% | N | +11% |
| | sodium silicate | 40% | | |
| | balance water | | | |
| 18 | potassium hydroxide | 35% | Y | +5% |
| | sodium silicate | 60% | | |
| | balance water | | | |
| 19 | potassium hydroxide | 10% | Y | +4% |
| | sodium silicate | 25% | | |
| | balance water | | | |
| 20 | potassium hydroxide | 50% | Y | −4% |
| | sodium silicate | 25% | | |
| | balance water | | | |
| 21 | potassium hydroxide | 75% | Y | −5% |
| | sodium silicate | 25% | | |
| | balance water | | | |

EXAMPLES 22-28

A third group of reaction dyeings of cotton fabrics identical to Examples 8-14 were made to determine the green dye yield of the candidate materials for liquid alkali added at 10 gms/l. The liquor ratio was 20 to 1. All color yield measurements are in comparison to a conventional dyebath containing 20 gms/l soda ash.

TABLE 4

| Green Dye Trial Results (con't) | | | | |
|---|---|---|---|---|
| Example | Composition | | Suitable | Yield |
| 22 | potassium hydroxide | 35% | Y | +1% |
| | sodium silicate | 10% | | |
| | balance water | | | |
| 23 | potassium hydroxide | 35% | Y | −2% |
| | sodium silicate | 25% | | |
| | balance water | | | |
| 24 | potassium hydroxide | 35% | Y | −3% |
| | sodium silicate | 40% | | |
| | balance water | | | |
| 25 | potassium hydroxide | 35% | Y | −4% |
| | sodium silicate | 60% | | |
| | balance water | | | |
| 26 | potassium hydroxide | 10% | Y | +6% |
| | sodium silicate | 25% | | |
| | balance water | | | |
| 27 | potassium hydroxide | 50% | N | −15% |
| | sodium silicate | 25% | | |
| | balance water | | | |
| 28 | potassium hydroxide | 75% | N | −26% |

TABLE 4-continued

| Green Dye Trial Results (con't) | | | | |
|---|---|---|---|---|
| Example | Composition | | Suitable | Yield |
| | sodium silicate | 25% | | |
| | balance water | | | |

EXAMPLES 29–35

Conventional reaction dyeings of cotton fabrics were made to determine the blue dye yield of the candidate materials. The dye selected was a mixture of 3.00% Remazol TM Turquoise R-P and 0.50% Remazol TM Blue R-W. These dyes are available from Hoechst Celanese of Summerville, N.J. The dyebath included 100 gms/l of sodium sulfate. Dyeing took place at 160° F. for 40 minutes. The liquid alkali was added at 2 gms/l. The liquor ratio was 20 to 1. All color yield measurements are in comparison to a conventional dyebath containing 5 gms/l soda ash and 2 gms/l caustic 50%.

TABLE 5

| Blue Dye Trial Results | | | | |
|---|---|---|---|---|
| Example | Composition | | Suitable | Yield |
| 29 | potassium hydroxide | 35% | N | −10% |
| | sodium silicate | 10% | | |
| | balance water | | | |
| 30 | potassium hydroxide | 35% | N | −25% |
| | sodium silicate | 25% | | |
| | balance water | | | |
| 31 | potassium hydroxide | 35% | N | −29% |
| | sodium silicate | 40% | | |
| | balance water | | | |
| 32 | potassium hydroxide | 35% | N | −28% |
| | sodium silicate | 60% | | |
| | balance water | | | |
| 33 | potassium hydroxide | 10% | N | −57% |
| | sodium silicate | 25% | | |
| | balance water | | | |
| 34 | potassium hydroxide | 50% | N | −13% |
| | sodium silicate | 25% | | |
| | balance water | | | |
| 35 | potassium hydroxide | 75% | Y | −1% |
| | sodium silicate | 25% | | |
| | balance water | | | |

EXAMPLES 36–42

A second group of reaction dyeings of cotton fabrics identical to Examples 29–35 were made to determine the blue dye yield of the candidate materials for liquid alkali added at 7 gms/l. The liquor ratio was 20 to 1. All color yield measurements are in comparison to a conventional dyebath containing 5 gms/l soda ash and 2 gms/l caustic 50%.

TABLE 6

| Blue Dye Trial Results (con't) | | | | |
|---|---|---|---|---|
| Example | Composition | | Suitable | Yield |
| 36 | potassium hydroxide | 35% | Y | +8% |
| | sodium silicate | 10% | | |
| | balance water | | | |
| 37 | potassium hydroxide | 35% | Y | +4% |
| | sodium silicate | 25% | | |
| | balance water | | | |
| 38 | potassium hydroxide | 35% | Y | −12% |
| | sodium silicate | 40% | | |
| | balance water | | | |
| 39 | potassium hydroxide | 35% | N | −16% |
| | sodium silicate | 60% | | |
| | balance water | | | |
| 40 | potassium hydroxide | 10% | N | −26% |
| | sodium silicate | 25% | | |
| | balance water | | | |

TABLE 6-continued

| Blue Dye Trial Results (con't) | | | | |
|---|---|---|---|---|
| Example | Composition | | Suitable | Yield |
| 41 | potassium hydroxide | 50% | Y | −9% |
| | sodium silicate | 25% | | |
| | balance water | | | |
| 42 | potassium hydroxide | 75% | N | −13% |
| | sodium silicate | 25% | | |
| | balance water | | | |

EXAMPLES 43–49

A third group of reaction dyeings of cotton fabrics identical to Examples 29–35 were made to determine the blue dye yield of the candidate materials for liquid alkali added at 10 gms/l. The liquor ratio was 20 to 1. All color yield measurements are in comparison to a conventional dyebath containing 5 gms/l soda ash and 2 gms/l caustic 50%.

TABLE 7

| Blue Dye Trial Results (con't) | | | | |
|---|---|---|---|---|
| Example | Composition | | Suitable | Yield |
| 43 | potassium hydroxide | 35% | Y | −7% |
| | sodium silicate | 10% | | |
| | balance water | | | |
| 44 | potassium hydroxide | 35% | Y | +2% |
| | sodium silicate | 25% | | |
| | balance water | | | |
| 45 | potassium hydroxide | 35% | N | −16% |
| | sodium silicate | 40% | | |
| | balance water | | | |
| 46 | potassium hydroxide | 35% | N | −20% |
| | sodium silicate | 60% | | |
| | balance water | | | |
| 47 | potassium hydroxide | 10% | N | −27% |
| | sodium silicate | 25% | | |
| | balance water | | | |
| 48 | potassium hydroxide | 50% | N | −18% |
| | sodium silicate | 25% | | |
| | balance water | | | |
| 49 | potassium hydroxide | 75% | N | −29% |
| | sodium silicate | 25% | | |
| | balance water | | | |

These results clearly show that the present invention, as shown in Example 1–3, 22–24, and 36–38, will provide good color yield on various dyes, including alkali sensitive dyes for typical amounts of alkali of 3 to 10 gms/l in the dyebath. The above examples also show that the present invention is an acceptable substitute for phosphorus-based alkali for reactive dyeing of cotton and cotton blended fabrics or the like.

Accordingly, the amount of silicate in the present invention can be varied between a low of about 10 to a high of about 40 wt % of 50° Baumé with 25 wt % being most preferred. Similarly, the amount of 45 wt % concentration alkali metal hydroxide in the present invention varies between a low of about 30 to a high of about 40 wt % with 35 wt % being most preferred. Thus, the composition has the following properties:

Appearance: Clear liquid
1% pH: 12.2–12.4
45 wt % Potassium Hydroxide: 30–40 wt %
50° Baumé Sodium Silicate: 10–40 wt %

This provides a liquid alkali product that can be used at between about 2 to 10 gms/l in the dyebath.

In the preferred embodiment, the process also included adding up to about 5 wt % sodium metaborate or sodium perborate to the liquid alkali as a final step. The borates act as a buffer. The effect of the borate can best be seen in FIG. 1 which is a graphical representation of the titration curves for 1% solutions of liquid alkalis prepared according to the present invention. As can be seen, the liquid alkalis containing borates have a more gradual slope than the liquid alkali without borate. This more gradual slope has a slight drop in the high end of the pH curve but still has a high enough pH to achieve reaction between the dye and fiber. In addition, the alkali is better buffered to achieve this reaction slowly so that the fiber reactive dyes fix in a more level, uniform fashion. However, as shown above, the dyebath tests have shown that the mixture can be made without the borate and still provide satisfactory yield.

Certain modifications and improvements will occur to those skilled in the art upon reading of the foregoing description. By way of example, sodium hydroxide could be used in place of potassium hydroxide. Also, carbonates are possible substitutes for the borates. It should be understood that all such modifications and improvements have been deleted herein for the sake of conciseness and readability but are properly within the scope of the following claims.

We claim:

1. A liquid composition for use in reactive dyeing of cotton and cotton blended fabrics or the like, said composition consisting essentially of:

(a) about 13 to 18 wt % of an alkali metal hydroxide;

(b) about 10 to 40 wt % of an alkali metal silicate at 50° Baumé;

(c) about 5 wt % of a borate selected from the group consisting of borax, sodium metaborate and sodium perborate; and (d) the balance water.

2. The composition according to claim 1, wherein the alkali metal of said alkali metal hydroxide and said alkali metal silicate is selected from the group consisting of potassium and sodium.

3. A process for dyeing of cotton and cotton blended fabrics or the like with a reactive dye comprising the step of adding to the dyebath between about 2 to 10 gms/l of a liquid composition consisting essentially of: (a) about 13 to 18 wt % of an alkali metal hydroxide; (b) about 10 to 40 wt % of an alkali metal silicate at 50° Baumé; (c) about 5 wt % of a borate selected from the group consisting of borax, sodium metaborate and sodium perborate; and (d) the balance water.

4. The process according to claim 3, the composition thereof, wherein the alkali metal of said alkali metal hydroxide and said alkali metal silicate is selected from the group consisting of potassium and sodium.

* * * * *